United States Patent [19]

Forrest

[11] 4,444,141

[45] Apr. 24, 1984

[54] STARTING POSITION INDICATOR FOR INDUSTRIAL SEWING MACHINE

[75] Inventor: David Forrest, Jamesburg, N.J.

[73] Assignee: The Singer Company, Stamford, Conn.

[21] Appl. No.: 377,232

[22] Filed: May 11, 1982

[51] Int. Cl.[3] ..... D05B 29/12

[52] U.S. Cl. ..... 112/271; 112/235; 33/169 B

[58] Field of Search ..... 112/235, 271, 272, 273, 112/276, 277, 221; 139/1 D, 348, 370.2; 33/169 B

[56] References Cited

U.S. PATENT DOCUMENTS

| | | | |
|---|---|---|---|
| 2,483,138 | 9/1949 | Helmer . | |
| 2,690,724 | 10/1954 | Eisenbeiss | 112/277 X |
| 2,910,027 | 10/1959 | Winz . | |
| 3,274,692 | 9/1966 | Morrison | 33/169 B |
| 3,302,600 | 2/1967 | Cheron . | |
| 3,623,441 | 11/1971 | Schoij | 112/235 |
| 3,827,381 | 8/1974 | Baanstra et al. . | |

FOREIGN PATENT DOCUMENTS

| | | |
|---|---|---|
| 885976 | 1/1970 | Italy . |
| 41-482241 | 9/1966 | Japan . |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A position indictor for an industrial sewing machine, particularly a programmable industrial sewing machine, in which an elongate slender member may be selectively extended through a tubular conduit to have an end of the member adjacent the work supporting bed so as to indicate to an operator the starting position for a work material from which stitching may initiate. The elongate slender member, which is best implemented by a wire, may also be used as an edge guide or a pivot point. Extension of the member through the flexible conduit may be initiated by an air cylinder or solenoid, and may be initiated by program control to take place when the sewing needle and the sewing machine presser foot are elevated.

11 Claims, 7 Drawing Figures

STARTING POSITION INDICATOR FOR INDUSTRIAL SEWING MACHINE

BACKGROUND OF THE INVENTION

This invention is in the field of sewing machines; more particularly, it is concerned with a starting position indicator for use with an industrial sewing machine, particularly of the programmable variety.

The increased use of programmable systems on industrial sewing machines has led to a need for accurately determining the starting position of the article being operated upon, particularly when a stitch count is used as a means of seam length control. An accurate starting position is essential for good quality stitching and requires a great deal of skill of the operator when performed at speeds commensurate with high output.

Any device which may be utilized to indicate the starting position to an operator must be adaptable to a variety of positions in order to facilitate its function as a starting position indicator for the variety of stitching tasks to which a particular industrial sewing machine may be applied. Also, the device must not interfere with the normal operation of the sewing machine.

SUMMARY OF THE INVENTION

The above desired ends are attained in a device which may be shifted to an out-of-the-way position when the sewing machine is in use, but may be extended to a position in contact or nearly in contact with the throat plate at the starting point, for example, when the presser foot and sewing needle are in an up position. Thus, the device may be implemented by a flexible cable having a central wire which may be extended to a position in contact with or spaced from the sewing machine bed by a solenoid or air cylinder. The extent of shift of the central wire may be regulated to provide for contact with the work surface, or may be spaced therefrom to allow a selected number of plies of work material to be positioned therebeneath. A mounting may be provided for the end of the flexible cable which will permit a sewing mechanic to locate the end of the central wire in a position dictated by the stitching task to be performed by the sewing machine. The end of the central wire may be formed into a triangular shape facing forwardly so that the edge of a work material being positioned is guided downwardly to an apex of the triangle in contact with, or spaced from, the work supporting surface of the sewing machine.

Additionally, the device may find utility as an edge guide, in which the central wire may be located contiguous of edge of work material. The device may find further utility as a pivot point for work material when the presser foot and needle are in an elevated position. A rigid tube may be used in place of a flexible cable for those industrial sewing machines having a dedicated use in which there is no need to reposition the centrally disposed wire.

DESCRIPTION OF THE DRAWINGS

For a better understanding of the invention, reference may be had to the specification and the attached drawings in which:

Referring now to FIGS. 1, 2 and 3 there are shown elevations of portions of a sewing machine 10 including a portion of the head end 12, bed 14 and bracket arm 16. Extending downwardly to the bed 14 from the head end 12 is a presser bar 18 which terminates in a presser foot 19. A bracket 20 is clamped to the head end 12 by screws 21, and is formed with a pair of apertures 22 on opposite sides thereof, only one of which is visible. Also visible is a needle bar 24 to the end of which is clamped in any known fashion a sewing needle 23. A U shaped support 26 (see also FIG. 3) is clamped to the bracket 20 by a nut and bolt combination 27 through one of the apertures 22, and extends downwardly to be clamped between a nut plate 28 and an indicator support plate 30. A pair of screws 34 are provided which extend through slot 31 in the indicator support plate 30, through apertures (not shown) in the support 26 into threaded openings (not shown) in the nut plate 28. In the forward end of the indicator support plate 30 is aperture 32 to receive a flexible or Bowden cable 36 retained to the indicator support plate by nut 37. The flexible cable 36 may, for example, be implemented by a tightly coiled spring encircling a wire 38 movable in the interior thereof. The opposite end of the flexible cable 36 extends, and is attached, to an ear 43 of a sheet metal platform 42 having an upwardly extending member 44 connected by screws 45 to a support bracket 46 affixed to the rear of the sewing machine bracket arm 16. The sheet metal platform 42 is fashioned with a lanced up portion 48 (see FIG. 4) having an aperture (not shown) therein to receive a solenoid 50 which is attached thereto by means of nut 51.

Referring to FIG. 4 it can be seen that armature 52 of the solenoid 50 is connected to a transverse member 54. One end of the transverse member is split as at 56 (see FIG. 3) to receive and clamp therein by means of screw 57 the wire 38. Additionally, the lanced up portion 48 supports an adjustable stop implement by a pair of nuts 60 on either side of lanced up portion, which nuts receive a screw 61 for selective extension therethrough. When the solenoid 50 is activated, the transverse member 54 is drawn toward the solenoid to the extent permitted by the screw 61 extending through the nuts 60. Motion of the transverse member 54 moves the wire 38 which is sufficiently rigid to transfer this motion without buckling.

Figure 3:
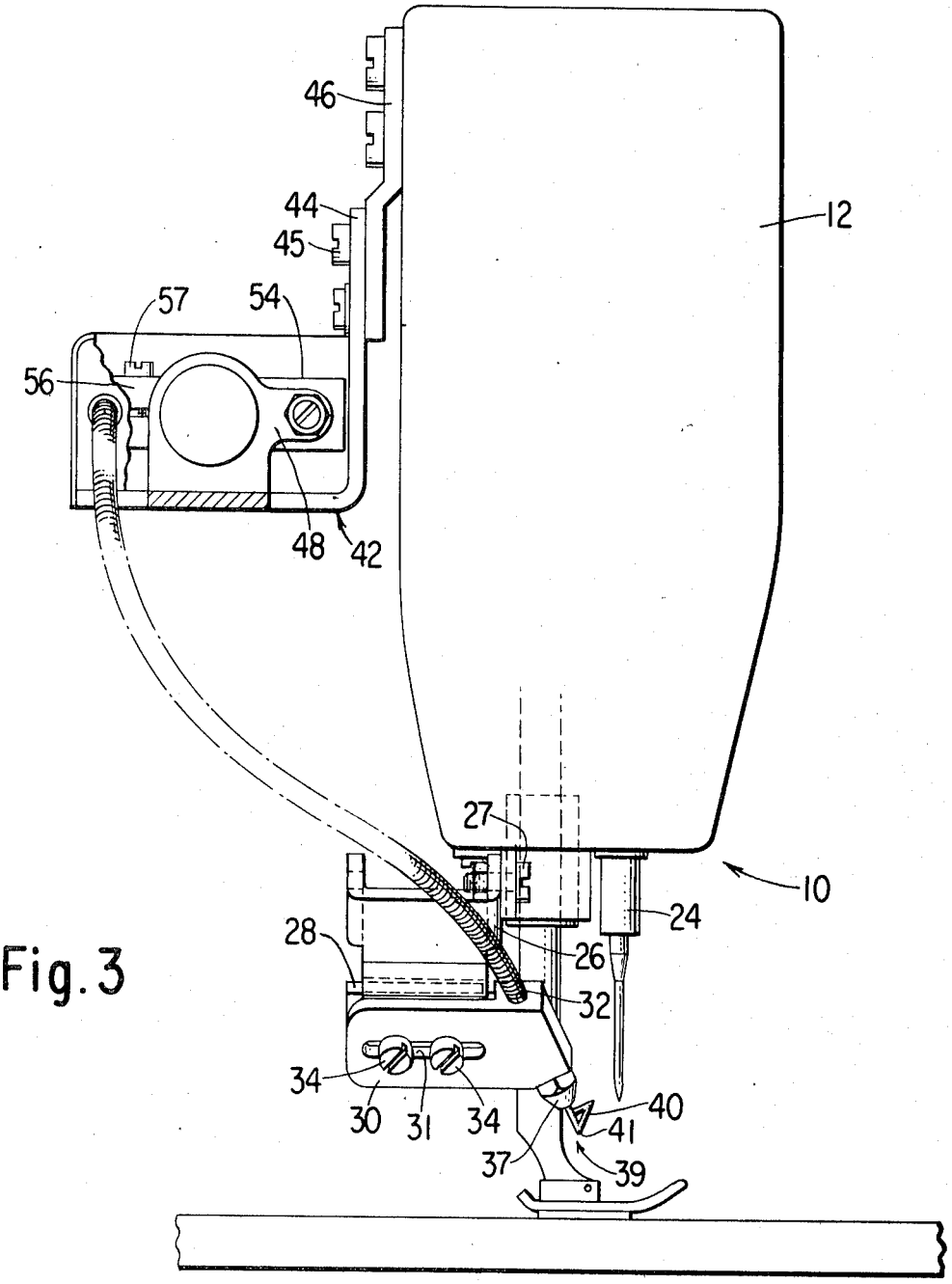
FIG. 3 is a side elevational view of the sewing machine shown in FIGS. 1 and 2.

The operative end of the wire 38 close by the sewing machine bed 14, is fashioned with a starting position indicator 39 utilizing a cloth guiding shape (see FIGS. 3 and 7) implemented by an angular arrangement in which an acute angle formed near the end of wire 38 indicates the starting point for stitching, with a side 40 of the acute angle operating to deflect cloth thrust at the cloth guiding shape towards the apex 41 of the angle.

Figure 1:
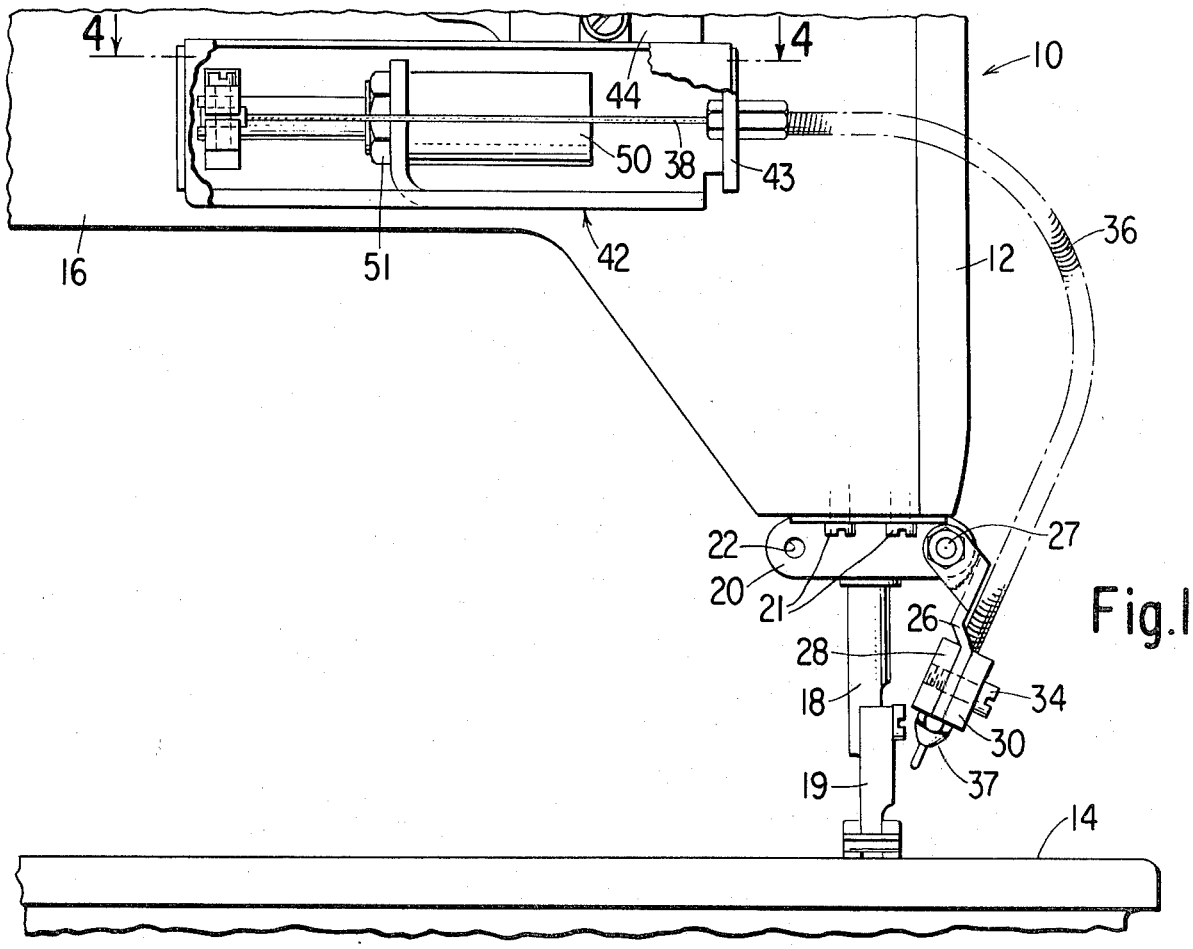
FIG. 1 is a rear elevational view of a portion of a sewing machine to which the invention has been applied.
Figure 2:
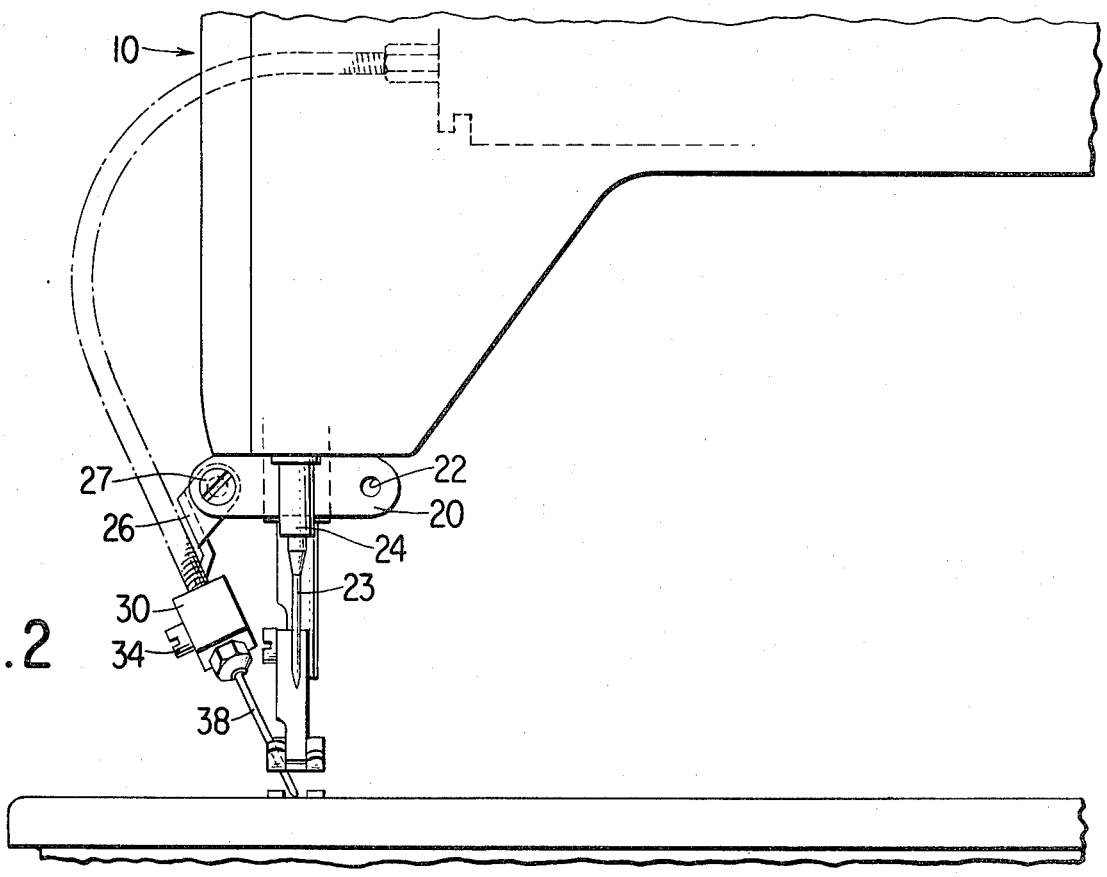
FIG. 2 is a front elevational view of the portion of a sewing machine shown in FIG. 1 showing the invention in an operative position.
Figure 4:
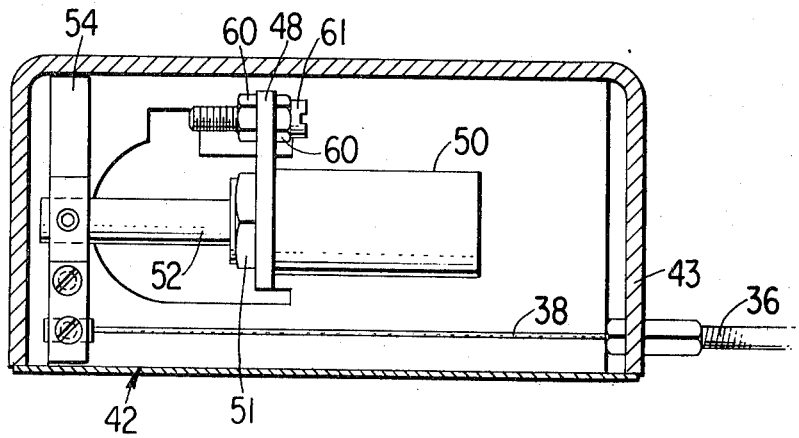
FIG. 4 is a view taken substantially along the line 4—4 of FIG. 1 to show details of the actuating mechanism for the starting position device.
Figure 5A:
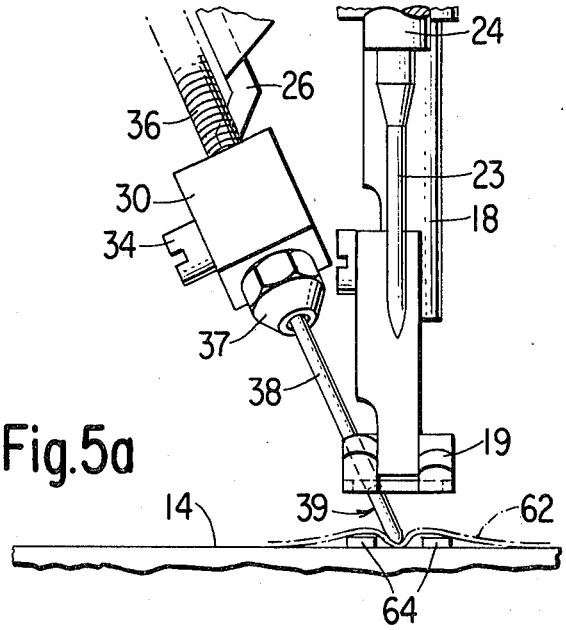
FIGS. 5 a. through d. are front elevational views of the invention in various operating positions.

In FIGS. 5 a. through d. there are shown various views depicting use of the starting position indicator 39. In FIG. 5*a*, there is shown the configuration also shown in FIG. 2 in which the presser foot 19 is elevated out of contact with the work material and the apex 41 of the starting position indicator 39 is in contact with a work material 62 supported on the work supporting bed 14 between feeding dogs 64 so that another piece of work material (not shown) may be positioned at the apex of the starting position indicator preparatory to stitching thereon, or incident to its use as a pivot point. In an automatic or semiautomatic sewing machine, it may be arranged that elevation of the presser foot 19 out of contact with the work material will initiate extension of the starting position indicator 39 to the position shown FIG. 5*a*. Alternately, a further action may be required to initiate extension of the starting position indicator 39 such as a second heel position of a sewing machine foot treadle beyond neutral position. In any event, an electrical interlock may be provided to prevent extension of the starting position indicator 39 to the position shown in FIG. 5*a* if the presser foot 19 has not been elevated. In FIG. 5*b*, the starting position indicator 39 is shown extending past the presser foot 19 on the opposite side from that shown in FIG. 5*a*, a position which may be readily accommodated by mounting the support 26 on the opposite aperture 22 of bracket 20 by means of the second ear thereof and by rearranging the nut plate 28 and indicator support plate 30 thereon. FIG. 5*c* indicates another position of the starting position indicator 39 accommodated by rotating the support 26 about the nut and bolt combination 27. Front to back positioning of the starting position indicator 39 may be accommodated by loosing the screws 34 and sliding the indicator support plate 30 in the desired direction as permitted by the extent of the slot 31. If necessary the extent of travel of the starting position indicator 39 to the work supporting bed 14 or to a work material 62 situated thereupon may be varied by adjusting the position of the screw 61 limiting the movement of the transverse member 54 (see FIG. 4). It will further be apparent to those skilled in the art that the starting position indicator 39 in the position shown in FIGS. 5*c* and *d* may also be useful as an edge guide in, for example, hemming a work material.

Figure 6:
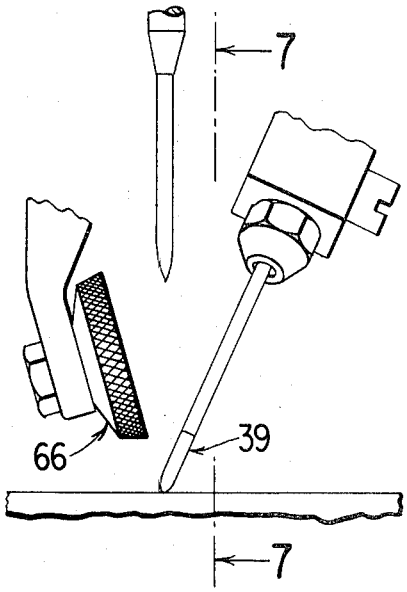
FIG. 6 is a front elevational view of the invention utilized with a roller presser foot; and, FIG. 7 is a side view of the invention shown in FIG. 6 taken substantially along the line 7—7 thereof.
Figure 5B:
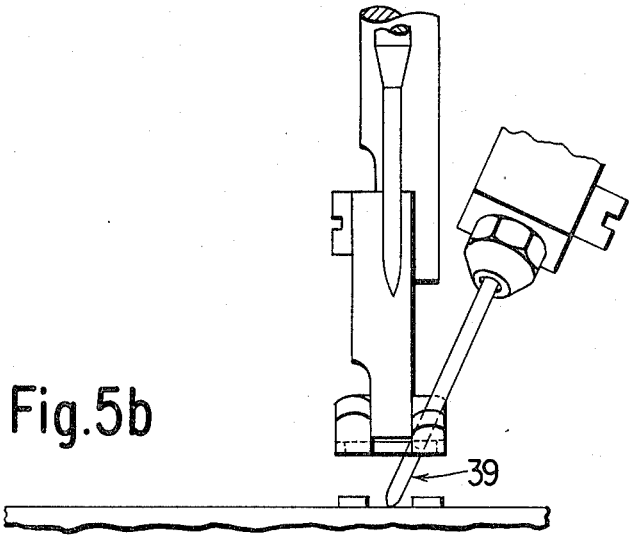
Figure 7:
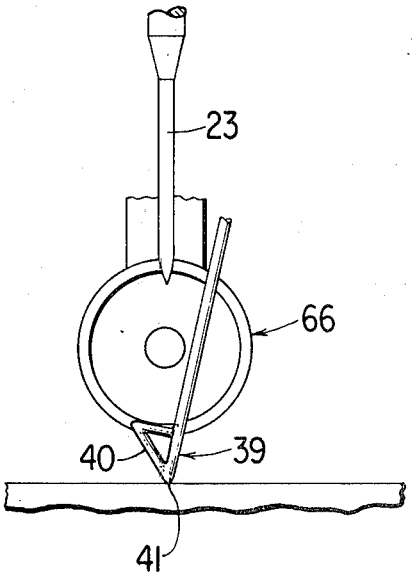
Figure 5C:
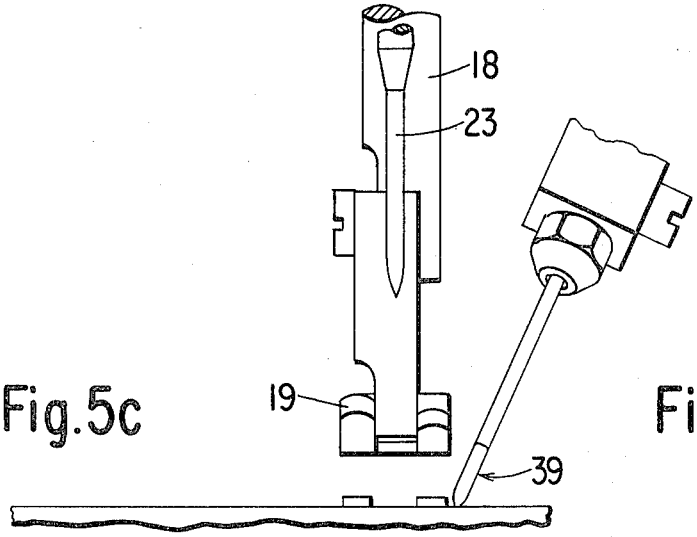
Figure 5D:
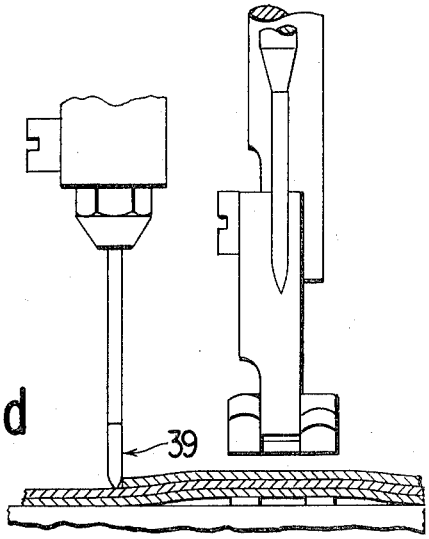

In FIG. 6 the starting position indicator 39 is shown as it would be utilized with a roller presser foot 66. In FIG. 7, a side view of FIG. 6, there is indicated the position of the starting position indicator 39 which would subsequently allow the roller presser foot 66 to feed work material beneath the sewing needle 23. The apex 41 of the starting position indicator 39 may be set to contact the work supporting bed 14 so that the material to be stitched upon may be butted against the indicator, or the apex may be spaced from the work supporting bed a sufficient distance to accommodate a selected number of plies of work material to be held by the apex while an additional layer or layers of work material may be positioned against the indicator. Both the position in contact with the work supporting bed 14 and the position spaced therefrom may be referred to as adjacent the work supporting bed. Alternately, by adjustment of screw 61, the apex 41 may be positioned to allow a layer or layers of work material to be positioned therebeneath and an upper layer to be positioned thereagainst. With the roller presser foot, the starting position indicator 39 may be used as both a starting position indicator and edge guide. When used as an edge guide, the starting position indicator 39 may be programmed to retract at pivot points to allow clear rotation of the work material therebeneath. On a two needle sewing machine, when the machine is stopped in the needle up and presser foot up state for pivoting, the apex 41 of the starting position indicator 39 may be used to hold the sewing material during the pivoting thereof.

It will be apparent to those skilled in the art that a pneumatic or hydraulic actuator may be used in place of the solenoid 50 without detracting from the utility of the invention. It will also be apparent that the flexible cable 36 may be replaced by a rigid pipe and the use of the support 26 thereby eliminated in those applications where the starting position indicator 39 is required in one position due to a dedicated use for the sewing machine.

Numerous alterations of the structure therein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit and scope of the invention are to be included within the appended claims.

I claim:

1. A position indicator for an industrial sewing machine having a frame including a work supporting bed and supporting therein a presser bar for selectively urging a work material against said work supporting bed and a needle carrying needle bar for stitching on said work material, said position indicator indicating to an operator a starting position for said work material, the indicator comprising: an elongated slender member of sufficient rigidity to enable endwise motion by exerting a force on one end thereof, tubular means for enclosing said member, means for supporting at least one end of said tubular means, and means for selectively exerting said force for extending said member through said tubular means to place the other end thereof in a selected position adjacent said work supporting bed to indicate said starting position for said work material.

2. A position indicator as claimed in claim 1 wherein said other end of said member is formed with a bent back limb to make a acute angle with the member, the apex of which is located adjacent said work supporting bed to indicate a starting position for a work material, said bent back limb operating to guide a work material to said apex.

3. A position indicator as claimed in claim 2 wherein said tubular means further comprises a flexible coiled spring; said supporting means further comprising means for sustaining the end of said flexible coiled spring most closely adjacent said other end of said member in a chosen location to have said other end of said member extended by said extending means to said selected position.

4. A position indicator as claimed in claim 1 wherein said exerting means further includes means for adjusting the position of said other end of said member when in an extended position.

5. A position indicator as claimed in claim 1 wherein said exerting means is implemented by a solenoid, said solenoid having a armature and supported by a member carrying a screw limiting the travel of a transverse member attached to the armature whereby the extent of motion of the other end of said wire may be adjusted to a selected position adjacent or contiguous said work supporting bed.

6. A position indicator as claimed in claims 1, 2, 3 or 5 in which said elongate slender member is implemented by a wire.

7. A position indicator for a programmable sewing machine having a frame including a work supporting bed and means for automatically selectively elevating a presser device out of contact with work material and for selectively elevating a sewing needle to an up position out of contact with the work material, the indicator comprising: an elongate slender member of sufficient rigidity to enable endwise motion by exerting a force on one end thereof; tubular means for enclosing said member, means for supporting at least one end of said tubular means, and means for selectively exerting said force for extending said member through said tubular means to have the other end thereof in a selected position adjacent said work supporting bed at least when said presser device is elevated and said sewing needle is in said up position.

8. A position indicator as claimed in claim 7 wherein said tubular means further comprises a flexible coiled spring; and said supporting means further comprises means for sustaining the end of said flexible coiled spring most closely adjacent said other end of said member in a chosen location to have said other end of said member extended by said exerting means to said selected position.

9. A position indicator as claimed in claim 8 wherein said sustaining means further comprises a bracket having an ear fastened to said sewing machine frame for swinging in a lateral plane and having a longitudinally extending porition with at least one aperture therethrough, a indicator support plate receiving said end of said flexible coiled spring most closely adjacent said other end of said wire, said indicator support plate situated contiguous one side of said longitudinal portion of said bracket and having a longitudinal slot therein, a nut plate situated contiguous the other side of said bracket and having at least one threaded aperture therethrough, and at least one bolt extending through said longitudinal slot of said indicator support plate and said at least one aperture of said bracket to said at least one threaded aperture of said nut plate, whereby the position of said other end of said wire exerting by said extending means may be adjusted to said selected position.

10. A position indicator as claimed in claim 8 wherein said exerting means includes means for adjusting the position of said other end of said wire when in an extended position.

11. A position indicator as claimed in claim 7 wherein said exerting means is implement by a solenoid, said solenoid having a armature and supported by a member carrying a screw limiting the travel of a transverse member attached to the armature whereby the extent of motion of the other end of said wire may be adjusted to a selected position adjacent or contiguous said work supporting bed.

* * * * *